United States Patent [19]

Veeck et al.

[11] 4,212,669

[45] Jul. 15, 1980

[54] METHOD FOR THE PRODUCTION OF PRECISION SHAPES

[75] Inventors: Stewart J. Veeck; William R. Freeman, both of North Muskegon; Louis E. Dardi, Muskegon, all of Mich.

[73] Assignee: Howmet Turbine Components Corporation, Muskegon, Mich.

[21] Appl. No.: 930,810

[22] Filed: Aug. 3, 1978

Related U.S. Application Data

[63] Continuation-in-part of Ser. No. 705,087, Jul. 14, 1976, Pat. No. 4,104,782.

[51] Int. Cl.[2] ..... B22F 5/00

[52] U.S. Cl. ..... 75/226; 75/211; 264/111

[58] Field of Search ..... 75/226, 211; 264/111

[56] References Cited

U.S. PATENT DOCUMENTS

| | | | |
|---|---|---|---|
| Re. 28,301 | 1/1975 | Havel | 75/226 |
| 3,992,200 | 11/1976 | Chandhok | 75/226 |
| 4,023,966 | 11/1975 | Loersch | 75/226 |
| 4,081,272 | 3/1978 | Adlerborn | 75/226 |
| 4,104,782 | 8/1978 | Veek et al. | 75/226 |

*Primary Examiner*—Brooks H. Hunt

*Attorney, Agent, or Firm*—McDougall, Hersh & Scott

[57] ABSTRACT

A method for producing precision shapes which includes the consolidation of powder metal preforms into a shaped porous preform. A first coating is applied to the preform, this first coating being porous while providing a diffusion barrier. A second coating which is also initially porous is then applied and the coated preform can then be degasified by subjecting the preform to a vacuum, particularly at elevated temperatures. The coated preform is then heated under vacuum to a temperature such that the second coating is densified to the extent that it becomes non-porous. Finally, the preform is subjected to a hot isostatic pressing operation whereby formation of high integrity, fully dense metal shape results.

10 Claims, 3 Drawing Figures

METHOD FOR THE PRODUCTION OF PRECISION SHAPES

This application is a continuation-in-part of application Ser. No. 705,087, filed on July 14, 1976, now U.S. Pat. No. 4,104,782, entitled "Method For Consolidating Precision Shapes".

BACKGROUND OF THE INVENTION

1. Field of the Invention

This invention relates to the production of metal shapes of high integrity whereby superior properties characterize the metal shapes. The invention is particularly concerned with the production of metal shapes utilizing powder metallurgy techniques.

2. Description of the Prior Art

It is well established that powder metallurgy techniques are highly useful for achieving certain advantages in the production of metal shapes. The techniques enable the production of homogeneous metal shapes even where rather complex shapes are involved. In the case of superalloys, for example, a uniform and extremely fine grain structure can be attained, and this grain structure is desirable for achieving certain improved mechanical properties. Furthermore, powder particles of superalloy composition can be consolidated and heat treated to achieve a comparatively larger grain structure whereby more suitable high temperature performance is rendered possible. These capabilities are achieved along with the more conventional advantages of power metallurgy. Specifically, attainment of near net shapes (0.1 inch oversize envelopes) is possible, and this represents cost savings up to about 75 percent over conventional forgings.

One technique available for achieving consolidation of powders is hot isostatic pressing. In such an operation, the powder is located in an autoclave and heated to a temperature sufficient to achieve densification and particle bonding in response to isostatic pressure. Pressure in the order of 15,000 psi is typically applied to the powder, and under such conditions, consolidation of the powder particles is achieved with a minimum of internal voids and other defects when compared with casting operations.

One difficulty encountered in the use of hot isostatic pressing involves the need for some means of encapsulating the powder prior to the application of the isostatic pressure. Thus, the powder is porous in nature and in the absence of some encapsulating means, the gas used for applying pressure would penetrate the powder and thereby equalize pressure internally of the preform so that consolidation could not be achieved. Accordingly, the state of the art uses various means such as formed metal, glass, or ceramic containers to provide the necessary encapsulation of the metal powders. Havel U.S. Pat. No. 3,662,313, Chandhok U.S. Pat. No. 3,700,435, and Loersch U.S. Pat. No. 4,023,966 include such teachings.

These methods of powder consolidation are limited in terms of dimensional control and design flexibility of the final desired shape. For example, containment of powders in formed and welded metal cans is limited in design flexibility, particularly where nonre-entrant angles are concerned. In addition, weldments often provide significant localized strengthening of the can which can subsequently lead to poor reproducibility of the cam movement during hot isostatic processing.

Control of shape distortion is also a problem where ceramic molds, loaded with metal powder, are consolidated wherein metal cans using an intermediate pressure transmitting media. Furthermore, the use of glass containment creates a new set of problems in that the differential thermal expansion between the glass container and metal substrate during heating can result in fracture of the glass container and necessitate specialized handling. Penetration of the glass into the porous metal substrate, insufficient support strength (sagging), and dimensional control are other problems characteristic of glass containment utilization.

Barbaras U.S. Pat. No. 3,455,682, Iler U.S. Pat. No. 3,469,976, Baba U.S. Pat. No. 3,585,261 and Lange U.S. Pat. No. 4,041,123 teach a technique involving the use of a mold or cavity for receiving metal powder. A ram is then utilized to compact the powder through a separate pressure transmitting medium such as thoria or vitreous glass while the combination is being heated. Among other problems, these techniques can result in penetration of the compact by the medium so that subsequent machining is required.

Applicants' copending application teaches improvements in the production of precision metal shapes using powder metallurgy techniques. In accordance with these teachings, the preforms are initially provided with an all-encompassing porous coating after which the preform is subjected to a vacuum whereby the preform is degasified. The coated preform is then heated while the vacuum is being maintained to a temperature sufficient to densify the coating and to render the coating non-porous and pressure-tight. This step is followed by hot isostatic processing wherein the preform is located in a chamber surrounded by a gaseous atmosphere. The pressure in the chamber is elevated, and a temperature employed to the extent sufficient to achieve densification and particle bonding. The product of the operation comprises a consolidated powder compact with a minimum of internal voids and other defects of the type often characteristic of cast products. The products of the process are also not susceptible to penetration problems and other problems associated with the procedures described in the aforementioned patents.

SUMMARY OF THE INVENTION

The subject matter of this invention involves improvements in the procedures described in the aforementioned copending application. In particular, the concepts of this invention involve means for avoiding diffusion problems which have been recognized in connection with some coatings employed in the prior procedure. Diffusion of portions of the coatings into the preform substrate has been found to be detrimental to the properties of some of the products produced, and this invention involves a procedure for eliminating this problem while at the same time achieving the benefits of the process.

The procedure of this invention particularly involves the formation of layered coatings on a preform with one coating or layer providing a barrier layer and with a second outer coating being provided over the barrier layer. The barrier layer comprises a material which does not tend to diffuse into the substrate or which does not result in any detrimental effects in the substrate.

Both the barrier coating and the outer coating are porous when first applied to the preform. Accordingly, the coated preform can be degasified and then heated in a vacuum in the manner of the preforms of applicants' earlier application. The character of the outer coating is such that it will densify when subjected to the elevated temperatures whereby the outer coating is rendered non-porous and pressure-tight. In this fashion, the coated preform can be subjected to the hot isostatic pressing for consolidation of the preform into the desired final product. Thus, the invention achieves the desired non-porous coating to enable the use of the hot isostatic pressing while, at the same time, the invention avoids the detrimental effects of diffusion into the substrate.

DESCRIPTION OF THE PREFERRED EMBODIMENTS

The process of the invention generally involves the production of consolidated metal shapes which are originally formed by consolidating metal powders into the desired porous preform shape using any one of many viable methods, including (1) sintering of loose packed powders in suitably shaped reusable or expendable molds; (2) uniaxial or isostatic cold pressing of the loose packed powders in a metal die or rubber molds, respectively; and, (3) spark sintering or the like.

The invention further involves the utilization of hot isostatic pressing techniques whereby the porous powder preform is consolidated to full density by subjecting the preform to high isostatic pressure while maintaining an elevated temperature such that the powder particles will form into a consolidated mass.

The accompanying drawing illustrates a cross-sectional view of a turbine disc 10 which can be efficiently produced in accordance with the concepts of this invention. As is wellknown, parts of this type are utilized for aerospace applications and in gas turbines and other applications where strength at extreme temperatures is a critical factor. Moreover, such parts must be produced to near net shape tolerances, in order to achieve effective cost savings over conventional forgings. By utilizing powder metallurgy techniques, such tolerances can be achieved.

The steps of the invention involve the conventional practice of forming a preform from powder particles, and where turbine discs and other items requiring high temperature performance are involved, superalloy powders can be readily utilized. Pursuant to standard processing, the preform will be consolidated so that the preform will be substantially selfsustaining for handling purposes.

Figure 1:
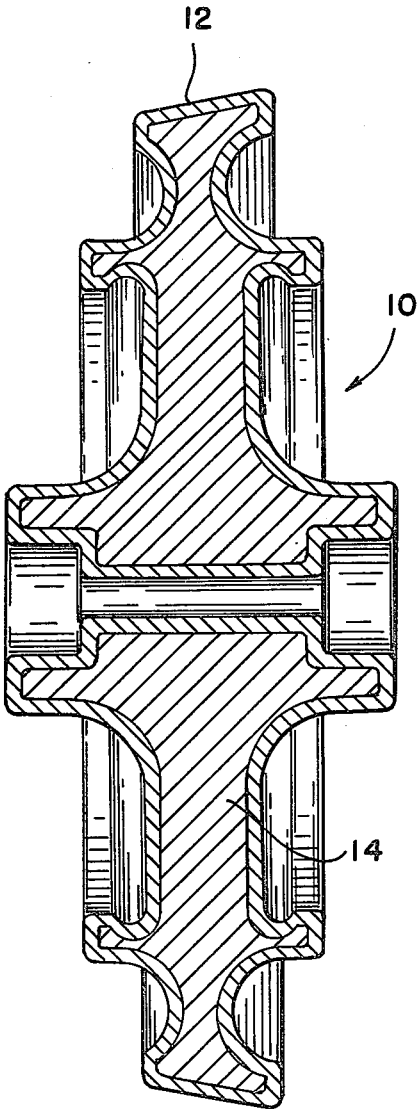
FIG. 1 is a cross-sectional view of a turbine disc which is a type of product produced in accordance with the process of the invention.
Figure 2:
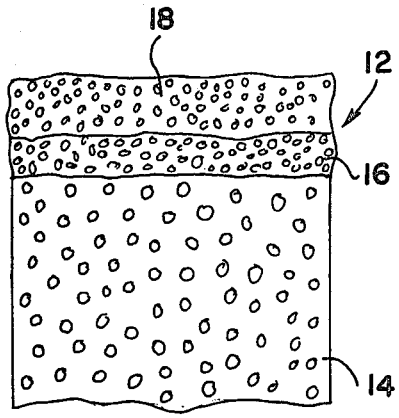
FIG. 2 is a fragmentary, cross-sectional view illustrating a powder preform and associated layered coating prior to degasification; and, FIG. 3 is a fragmentary, cross-sectional view illustrating the preform and layered coating subsequent to degasification and heating to form a non-porous outer layer.

In accordance with this invention, the preform is provided with a layered coating generally shown at 12 in FIG. 1, this coating extending completely around the substrate 14. As shown in FIG. 2, the coating 12 consists of an inner or barrier layer 16 and an outer layer 18. FIG. 2 illustrates the character of the layers after application at which time both layers are porous. In this condition, the preform is adapted to be degasified by locating the preform in a vacuum chamber so that gases in its interior will pass outwardly through the layers.

Figure 3:
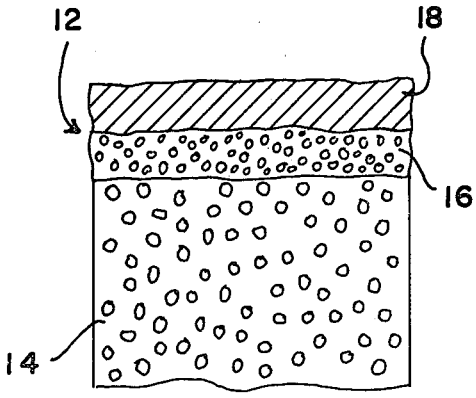

While maintaining the vacuum, the combination is heated to achieve the structure shown in FIG. 3. In particular, the outer layer 18 is adapted to fuse into a densified nonporous and pressure-tight layer. The layer 18 thus becomes impermeable to the entry of gas into layer 16 and into the substrate 14.

The structure of FIG. 3 is now adapted to be subjected to hot isostatic pressing. During this procedure, the layer 18 acts as an envelope preventing penetration of the gaseous medium used for applying pressure to the compact. The combination of heat and pressure conventionally used in such an operation results in the consolidation of the powder whereby a fully densified metal shape is achieved.

The material employed for foming barrier layer 16 may be selected from the group consisting of the refractory metal alloys of Group IVB, VB and VIB including hafnium, tungsten, molybdenum, and tantalum free of significant amounts of melting point depressants such as boron, carbon or silicon. High temperature alloys and intermetallic compositions including various superalloys, stainless steels (e.g. types 304 or 316), NiCr, CoCrAlY, NiCrAlY, NiAl, cermets including $Al_2O_3$+NiAl, and ceramics including alumina, zirconia, silica, beryllia, chrome oxide, yttria and magnesia, and combinations of these materials are also contemplated. These should also be free of significant amounts of melting point depressants.

A suitable barrier layer may have a composition the same as or similar to the substrate although it may be characterized by lesser porosity since the barrier layer will be typically applied by a conventional technique such as air or inert atmosphere plasma deposition, dip coating or resin bonding, or flame spraying.

In addition to being characterized by sufficient porosity to permit degasification of the substrate, the composition of the barrier layer must be such that it will remain essentially solid at the temperatures employed when fusing the outer layer to render the outer layer non-porous. This limits the possibility of diffusion and/or penetration of the barrier layer relative to the substrate, and it also operates to inhibit diffusion of outer layer elements into the substrate.

It is also necessary that the barrier layer be "wet" by the fusible or outer layer. The chemical composition of the barrier layer may be selected to provide constituents chemically reactive with constituents in the outer layer to enhance bonding of the outer layer to the barrier layer. As an example, molybdenum constituents in a barrier layer will react with boron present in an iron-boron outer layer.

It is also contemplated that an intermediate bonding layer could be utilized between the barrier layer and the outer layer. For example, a non-melting nickel-aluminum deposit may be utilized between an alumina barrier layer and an iron-boron fusible outer layer in order to enhance the bonding of the respective layers.

The composition of the fusible outer layer must be, as indicated, such that this layer will densify during a fusion cycle conducted after degasification. Thus, the combination of heat under vacuum conditions will result in melting of this outer layer selectively relative to the barrier layer and the underlying substrate which remain solid.

As an alternate to using a fusible outer layer, it is also possible to solid state sinter the outer layer to a density greater than or equal to 94 percent of theoretical density and still achieve a gas-tight, impermeable seal suitable for hot isostatic pressing. It will be appreciated that one skilled in the art can readily select a suitable sintering temperature just below the melting point to achieve said density in the outer coating and layer compositions, particularly within the guidelines hereinafter set forth, will also be apparent. Where references are made herein to "fusion" of the outer layer, it will be understood that layers formed by this alternative technique are included.

Since the preform is subjected to hot isostatic processing subsequent to the fusion cycle, the outer layer must be substantially solid under the temperature and pressure conditions of the hot isostatic process. Accordingly, the melting point of the outer layer after fusion must be above the hot isostatic processing temperature. The outer layer must have a melting point before fusion which is below the melting point of the substrate and barrier layer and which is also low enough to avoid deleterious effects on the substrate during the fusion cycle. For example, the fusion temperature of the outer layer must be such that detrimental substrate grain growth would occur because of the fusion temperature.

Suitable compositions for the outer layer comprise iron, cobalt and nickel base alloys or related Group VIII base metals. The alloying ingredients contemplated are known melting point depressants for the base materials such as boron, carbon and silicon. Iron base alloys containing between about 1 and 10 percent by weight boron and nickel base alloys containing between about 1 and 20 percent chromium, between about 1 and 10 percent boron, and amounts of carbon between about 0.05 and 1 percent are contemplated. It will be appreciated that one skilled in the art can readily select alloying ingredients for the general classes of alloys referred to in order to control melting points in accordance with well-known procedures. It is emphasized that the character of the outer layer can very widely from the general and specific examples given in view of the fact that applicants include a barrier layer which effectively prevents deleterious effects on the substrate which might otherwise result from the composition of the outer layer.

The barrier layer deposited should be a minimum of 0.003 inches thick, and although much thicker layers are operable, a practical upper limit for the thickness is about 0.015 inches. The outer fusible layer preferably has a minimum thickness of about 0.005 inches, and also a practical upper limit of about 0.015 inches.

As discussed, the combination of layers must be porous to permit degasification of the preform. In the usual practice of the invention, the sintered and coated preform will be heated slowly under a vacuum, and may be held at an intermediate temperature to allow complete degassing of the preform internal pore structure. In the case of a superalloy composition, this intermediate temperature will be in the order of 800° to 1000° F. In those instances where a layer has been applied to the preform with the aid of an organic binder, vacuum decomposition of the binder will be necessary at temperatures in the range of 300°-800° F.

The heating under vacuum is continued to a temperature sufficient to achieve densification of the outer porous layer or coating. Densification is preferably achieved by raising the temperature to the extent that a controlled liquid phase develops in the outer coating, or to the extent that sintering occurs. The densification renders the outer coating nonporous and, since the coating is provided all around the preform, the preform will be completely encapsulated, and its internal pores will be under vacuum. The preform will, therefore, be in a condition ideally suited for a hot isostatic pressing operation. Additionally, because of the intimate contact of the then encapsulating dual coating with the preform substrate and because of its relatively small section thickness, minimum distortion of the desired shape will occur during hot isostatic processing consolidation of the preform.

The hot isostatic pressing operation involves the introduction of an atmosphere, such as argon gas, and the maintenance of pressure between about 10,000 and 50,000 psi at a temperature sufficient to achieve complete densification of the preform.

In the case of superalloys, a suitable range of temperatures for achieving hot isostatic pressing will be in the range of from 50° F. below the gamma prime solvus temperature up to the solidus temperature for the material. Temperatures in the order of 2000° to 2200° F. are typical for hot isostatic pressing of superalloys. It is recognized, however, that specialized powder materials sometimes require extended temperature ranges for hot isostatic processing. For example, strain energy processed superalloy powders can be hot isostatic processed as low as 1800° F., which may be as much as 200° F. below the gamma prime solvus.

The known processing temperatures for hot isostatic pressing of the composition of the substrate are preferably utilized when selecting an outer coating for a given alloy composition. In view of the techniques described above, it is preferred that this coating material develop a liquid phase at a temperature above the temperature to be employed for hot isostatic pressing. With that relationship of temperatures, the coating can be densified into a non-porous encapsulating coating for purposes of undergoing the hot isostatic pressing.

Other factors will enter into the selection of the coating composition. Naturally, compositions for the barrier layer which would adversely affect the substrate must be avoided, and this includes alloy compositions susceptible to gross interdiffusion. The coating compositions must also be such that they will retain their integrity under the conditions to which they are subjected. Thus, the coating compositions cannot be such that they will crack during thermal processing due to the formation of some brittle phase. Furthermore, the coatings must be such that they will not crack due to differential thermal expansion or contraction between the coatings and substrate as temperature conditions change and thereby expose the preform to the high pressure atmosphere. Materials which can be removed selectively after hot isostatic processing using acid solutions which do not adversely affect nickel base substrates are also of interest.

The following comprise examples of the practice of the invention:

EXAMPLE I

A sintered Rene' 95 preform was prepared by gravity sintering −60 mesh Rene' 95 powders in an $Al_2O_3$ mold for four hours in vacuum at 2000° F. The composition of the Rene' 95 powder is set forth in the aforementioned application.

The sintered preform was plasma spray coated with a barrier layer of 0.010 to 0.012 inches of plasma spray grade 316 stainless steel using the following parameters:

| | |
|---|---|
| Gun to Work Distance | 12 in. |
| Primary Gas (Argon) | 100 CFH |
| Secondary Gas (Hydrogen) | 15 CFH |
| Voltage | 50 volts |
| Current | 150–300 amp |
| Carrier Gas (Argon) | 80 CFH |
| Meter Wheel Speed | 25 RPM |

This layer was then coated with an additional 0.010 to 0.012 inches of 325/500 mesh fraction of prealloyed iron—3 percent by weight boron powder prepared by gas atomization. The plasma spray parameters were as follows:

| | |
|---|---|
| Gun to Work Distance | 12 in. |
| Primary Gas (Argon) | 100 CFH |
| Secondary Gas (Hydrogen) | 15 CFH |
| Voltage | 50 volts |
| Current | 500 amp |
| Carrier Gas (Argon) | 50 CFH |
| Meter Wheel Speed | 15 RPM |

The plasma spray coating of both the stainless barrier layer and the iron-boron layer was performed in air using suitable gun-to-work distances to maintain the substrate temperature below 300° F. in order to minimize oxidation of the porous preform and to obtain a permeable coating system (70–80% T.D.).

The coated preform was subsequently vacuum heat treated at $10^{-4}$ Torr to both degas the preform and densify the fusible coating. The heat treat cycle used was as follows:

$$RT \xrightarrow{8^\circ\ F./Min.} 2050^\circ\ F.(\tfrac{1}{2}\ Hr.) \xrightarrow{8^\circ\ F./Min.} 2190^\circ\ F.(1/6\ Hr.) \leq \xrightarrow{8^\circ\ F./Min.} 300^\circ\ F. \xrightarrow{Gas\ Fan\ Cool} RT$$

The iron-boron alloy has a eutectic melting temperature of 2100° F., and the selected densification temperature of 2190° F. resulted in over 50 volume percent liquid under equilibrium thermal conditions. The time at peak temperature was limited to minimize the amount of diffusion into the barrier layer.

Hot isostatic pressing of the coated preform was performed at 2050° F. for four hours, at 15 ksi. The hot isostatic process cycle utilized a partial elevation of temperature under moderate pressure (<5 ksi) with full application of pressure (15 ksi) being applied above 1700° F. This caused the coating to be more ductile prior to the application of full pressure and minimized the potential for distortion or cracking of the coating. Subsequent examination of hot isostatic consolidated material revealed an interdiffusion zone between the coatings and substrate of about 0.02 inches. The coating was removed through the use of chemical etching methods.

Room temperature tensile property evaluations of a specimen consolidated in the preceding manner and subsequently heat treated yielded the following data:

| *UTS* (ksi) | *YS* (ksi) | Elong. (%) | *RA* (%) | 1200° F./150 ksi *S/R* (Hrs.) |
|---|---|---|---|---|
| 246 | 190 | 13 | 17 | 102 |

EXAMPLE II

A sintered Rene' 95 preform similar in composition to that described in Example I was prepared by gravity vacuum sintering −60 mesh Rene' 95 powders in an alumina mold for four hours at 2000° F. The sintered preform subsequently was plasma spray coated with a barrier layer of 0.005 to 0.010 inches of plasma spray grade molybdenum metal powder using the following parameters:

| | |
|---|---|
| Gun to Work Distance | 12 in. |
| Primary Gas (Argon) | 100 CFH |
| Secondary Gas (Argon) | 15 CFH |
| Voltage | 50 volts |
| Current | 200–400 amp |
| Carrier Gas (Argon) | 80 CFH |
| Metal Wheel Speed | 25 RPM |

This layer was subsequently coated with an additional 0.010 to 0.012 inches of 325/500 mesh fraction of prealloyed iron—3 weight percent boron powder using plasma spray parameters substantially identical to those described in Example I. The coated preform subsequently was vacuum heat treated under conditions identical to those described previously in order to fuse the coating and thus make it impervious and gas tight to the hot isostatic pressing environment. Hot isostatic pressing of the coated preform to full density was performed at 2050° F. for 4 hours at 15 ksi. The primary benefit obtained in using the molybdenum barrier layer was a reduction in the amount of diffusion of the boron from the outer fusible coating into the barrier layer.

EXAMPLE III

A sintered Rene' 95 preform similar in composition to that described in Example I was prepared by gravity vacuum sintering −60 mesh Rene' 95 powders in an alumina mold for four hours at 2000° F. The sintered preform subsequently was plasma spray coated with a barrier layer of 0.005 to 0.007 inches of commercial cermet type powder consisting of alumina+nickel-aluminide. The addition of NiAl to the $Al_2O_3$ promotes bonding to the substrate in this instance. This initial barrier coating was overcoated with an intermediate barrier layer of 0.010 to 0.015 inches of 316 stainless steel powder and both these layers were subsequently overcoated with an additional 0.010 to 0.012 inches of 325/500 mesh fraction prealloyed iron-3 weight percent boron powder. The plasma spray parameters for the intermediate stainless barrier layer and outermost coating were identical to those described in Example I. Plasma deposition of the innermost cermet layer required deposition currents in the range of 300 to 500 amps with the remaining plasma spray parameters being unchanged.

The coated preform subsequently was vacuum heat treated under conditions identical to those previously described in order to fuse the outer layer and obtain an impervious coating. Subsequent hot isostatic pressing of the coated preform to full density was performed at 2050° F. for four hours at 15 ksi. Utilization of this particular coating system offered reduced liquid phase penetration into the barrier layer and the intermediate barrier layer served to promote improved wetting between the innermost barrier layer and the outermost fusible layer.

The time and temperature figures given may vary since, for example, degassing could take place at higher or lower temperatures, and the temperature employed would affect the time of holding. Different times and temperatures can also be selected based on factors such as the degree of compacting of the preform and porosity of the coating. The most efficient degassing operation for a given substrate and coating can be readily determined by simple testing.

It will be understood that various other changes and modifications may be made in the practice of the invention without departing from the spirit of the invention particularly as defined in the following claims.

That which is claimed is:

1. In a process for producing metal shapes from powder particles which includes the steps of shaping the particles into a self-sustaining porous preform, applying a porous coating to the preform, subjecting the coated preform to a vacuum whereby the preform is degasified, conducting a fusion step comprising heating the coated preform, while maintaining the vacuum, to a temperature sufficient to render the coating non-porous and pressure-tight, and subjecting the preform to hot isostatic pressing, the improvement wherein said coating is applied by forming a first barrier layer on the preform, said barrier layer comprising a composition sufficiently porous to permit said degasification and which remains solid during said fusion step, and applying a second layer over said first layer, said second layer comprising a metal alloy which is initially porous to permit said degasification, which fuses during said fusion step, and which is solid during the subsequent hot isostatic pressing whereby said second layer provides the means for rendering the coating non-porous and pressure-tight.

2. A process in accordance with claim 1 wherein said fusion step is conducted at a temperature in excess of the temperature prevailing during said hot isostatic pressing.

3. A process in accordance with claim 2 wherein said preform is degasified at an elevated temperature below the temperature prevailing during said hot isostatic pressing.

4. A process in accordance with claim 1 wherein said layers are applied by one of the methods selected from the group consisting of flame spraying, plasma spraying, resin bonding, and dip coating.

5. A process in accordance with claim 1 including the step of removing said coating subsequent to said hot isostatic pressing.

6. A process in accordance with claim 1 wherein said process involves sintering of said second layer to render the second layer non-porous and pressure-tight.

7. A process in accordance with claim 1 wherein said first layer is between about 0.003 inches and about 0.015 inches thick, and said second layer is between about 0.005 inches and about 0.015 inches thick.

8. A method in accordance with claim 1 wherein said fusion step and said degasification is conducted simultaneously by gradually raising the temperature of the preform to the fusion temperature while maintaining the preform in a vacuum.

9. A process in accordance with claim 1 wherein said hot isostatic pressing is conducted by locating the preform in a pressure chamber, and wherein the temperature of said preform is initially raised in order to render the coating ductile while maintaining the preform at a pressure of less than 5000 psi, the pressure being thereafter raised in excess of 5000 psi.

10. A process in accordance with claim 1 including the step of applying an intermediate layer between said first layer and said second layer, said intermediate layer comprising a composition for improving wetting of the second layer relative to the first layer.

* * * * *